United States Patent [19]

Carnahan

[11] Patent Number: 4,709,522

[45] Date of Patent: Dec. 1, 1987

[54] REMOUNTABLE WALL/CEILING MOLDING

[76] Inventor: V. B. Carnahan, 522 Devils Hole Rd., R.D. #1, Cresco, Pa. 18326

[21] Appl. No.: 932,623

[22] Filed: Nov. 20, 1986

[51] Int. Cl.[4] ..... E04F 19/02

[52] U.S. Cl. ..... 52/287; 52/717.1; 52/DIG. 4

[58] Field of Search ..... 52/254, 287, 288, 716, 52/717.1, 718.1, DIG. 4

[56] References Cited

U.S. PATENT DOCUMENTS

| | | | |
|---|---|---|---|
| 1,825,010 | 9/1931 | Murphy | 52/287 |
| 2,951,311 | 9/1960 | Luther | 52/DIG. 4 |
| 2,981,988 | 5/1961 | Schweitzer | 52/288 |
| 3,292,328 | 12/1966 | Lewis et al. | 52/DIG. 4 |
| 3,449,873 | 6/1969 | Damato et al. | 52/127 |
| 4,573,288 | 3/1986 | Adell | 49/462 |
| 4,592,180 | 6/1986 | Gerritsen | 52/203 |

*Primary Examiner*—James L. Ridgill, Jr.
*Attorney, Agent, or Firm*—Ruth Moyerman

[57] ABSTRACT

A remountable molding for ceiling and wall uses magnets to hold molding strips in position. A plurality of magnetic mounting bars are preferably attached at intervals to a wall or ceiling near the wall/ceiling intersection. Molding strips with flat-sided ceiling and wall returns include metallic bands attached to the returns. When the bands are placed in contact with the magnetic mounting bars, the molding strips are held in place. The strips are easily removed and quickly remounted when the walls are painted or the room redecorated.

6 Claims, 5 Drawing Figures

REMOUNTABLE WALL/CEILING MOLDING

BACKGROUND OF THE INVENTION

1. Field of the Invention

This invention relates to static structures and more particularly to attached trim strips such as ceiling/wall moldings.

2. Background of the Prior Art

Many designs and types of ceiling/wall moldings are found in today's home decorating market. When first installed, they hide any uneven painting done when either walls or ceilings were first painted. For the non-expert, moldings not only decorate a room, they also hide errors in construction or painting. However, when a ceiling or wall needs repainting, the job becomes difficult, since it is not easy to avoid getting paint on the thick molding. Because all known moldings are fastened to the wall or ceiling with nails or screws, removal of the molding is difficult. Often the molding, particularly wood or plastic molding, is damaged in prying it from the wall. Metallic molding which is permanently mounted is found in U.S. Pat. No. 3,449,873 to Damato et al where metallic moldings are installed with brackets and screws.

Some devices have used magnetic means to hold molding; for instance automobile door moldings are disclosed in U.S. Pat. No. 4,573,288 to Adell and metal molding for doors and windows with metallic frames are discussed in U.S. Pat. No. 4,592,180 to Gerritsen. Currently there is no decorated ceiling/wall molding made of plastic, wood, or metal which is held to the wall by magnets.

There is, therefore, a need for an easily removed and remountable molding for home decorating.

SUMMARY OF THE INVENTION

The aforementioned prior art problems are obviated by the ceiling/wall molding of this invention in which molding is remountable. Each molding member is a continuous strip including a flat-sided ceiling return to abut a ceiling and a flat-sided wall return to abut a wall. A magnetized metallic band is fastened to either return or to the wall or ceiling. Bar magnets are attached either to the returns or to the wall or ceiling intermitting, for example, at intervals of approximately two feet. The molding is then cut to the desired lengths and mounted by being held to the wall/ceiling intersection where the metallic bands touch the magnets. When it is time to paint or remodel, the molding strips are easily pulled from the wall to be replaced when the painting is finished.

The molding may be wood, plastic, or metal, or any suitable material. When metal molding is used, the metallic bands may be extensions of the ceiling or wall returns. When the molding is wood or plastic, the metallic bands or magnets are attached to the returns or embedded in them.

It is, therefore, an object of this invention to provide a wall molding which is remountable for ease of installation and convenience during redecoration.

It is another object of this invention to provide a wall molding which is mounted to a wall by magnetic force.

It is yet another object of this invention to provide a remountable wall molding which can be made of any and all suitable materials for the purpose, such as plastic, wood, or metal.

These and other objects will be more readily ascertainable to one skilled in the art from a consideration of the following Figures, description and exemplary embodiments.

BRIEF DESCRIPTION OF THE DRAWING(S)

DETAILED DESCRIPTION OF THE PREFERRED EMBODIMENT(S)

Figure 1:
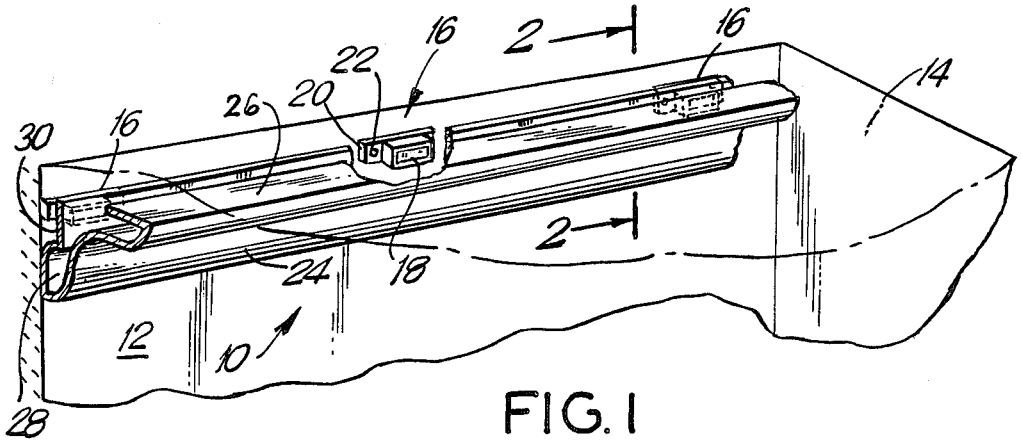
FIG. 1 is an isometric view of the molding of this invention installed on a wall with a cut-away to show the magnetic bars.

Now referring to the drawings, and more particularly to FIG. 1, remountable molding 10 is shown attached to an intersection of wall 12 and ceiling 14. Remountable molding 10 has molding strip 24 with wall return 28 and ceiling return 26. In this preferred embodiment, wall return 28 is fitted with magnetized metallic band 30.

Three magnetic mounting bars 16 are shown in this view, each having backing 20, attachment screws 22, and magnetic bar 18. For ease of installation, it is preferred that magnetic mounting bars 16 be installed on wall 12 at about 24-inch or 16-inch intervals. It is possible, and sometimes desirable, to use more mountings than illustrated or to space them in accord with the wall studs. It is also possible to place mounting bar 16 on ceiling 14, but wall installation is preferred. When mounting bar 16 is placed on a ceiling, magnetized metallic band 30 is secured to ceiling return 26.

To install a kit of the molding illustrated in Figure 1, a length of molding strip 24 is cut to the desired length. At least one magnetic mounting bar 16 for each two feet of strip 24, plus one bar 16 proximate each wall end, is attached to wall 12 at a predetermined distance from the ceiling edge. That distance will be such that ceiling return 26 will abut ceiling 14 when strip 24 is held to wall 12 by the attachment of magnetized metal strip 30 to magnetic mounting bar 16. Because it is not permanently attached, strip 24 is easily pulled from mounting bars 16 if adjustments must be made.

Figure 2:
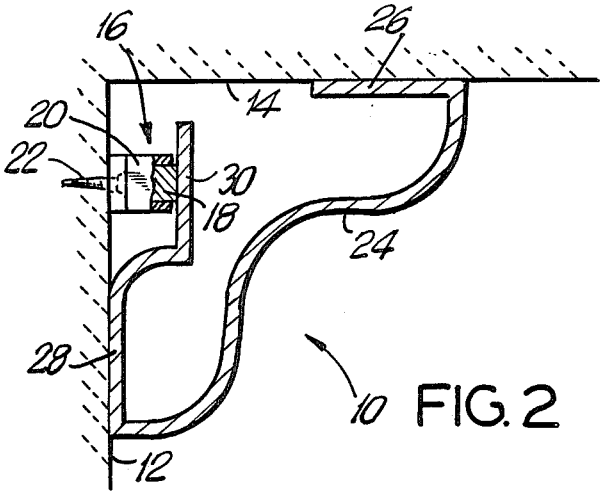
FIG. 2 is a cross section taken on lines 2—2 of FIG. 1 to show a wall return with a magnetic attachment band held to a magnetic mounting bar.

Now referring to FIG. 2, a cross section illustrates the attachment of molding 10 to wall 12 by magnetic band 30 on return 28. In FIG. 2, molding strip 24 is metallic and magnetic band 30 is an extension of return 28. Band 30 is magnetically attached to magnet 18 and that attraction holds strip 24 to wall 12. It can be seen in FIG. 2 that there is room for vertical adjustment of band 30 on magnet 18 so that it can be assured that return 26 will abut ceiling 14. Bar 16 is attached to wall 12 by screw 22 through backing 20. Mounting bar 16, and particularly the depth of bar 18, is presized so that when molding 10 is in place, return 28 abuts wall 12.

Figure 3:
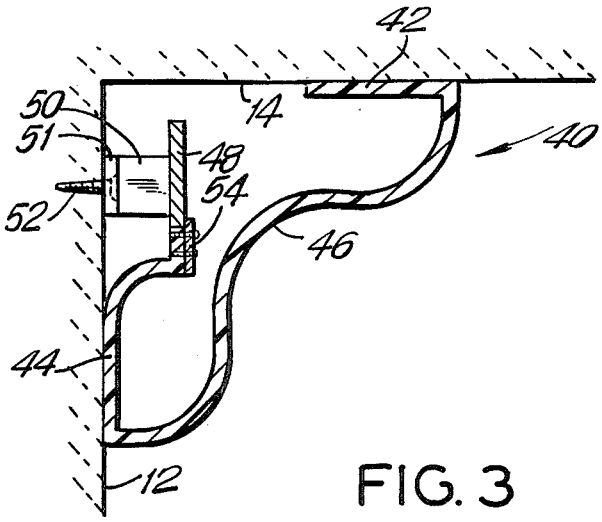
FIG. 3 is a cross section of an alternative embodiment of a molding made of wood and plastic.

Now referring to FIG. 3, an alternative embodiment of the molding of this invention is illustrated. Molding 40 has molding strip 46, ceiling return 42, and wall return 44. Because molding 40 is wood, or plastic, metallic band 48 is not an extension of return 44 but is attached to return 44 by clip 54. Magnet 50 is attached to wall 12 by screw 52 through backing 51. Thus the molding of this invention can be wood, plastic, or metal.

It should be noted that although the Figures show metallic bands attached to the returns and magnetic mounting bars attached to the wall, the arrangement may be reversed. For example, in FIG. 3, instead of magnetized metallic strip 48 attached to return 44, magnet 50 may be so attached. Then, metallic strip 48 would be mounted to wall 12. Metallic strip 48 would be mounted to ceiling 14 if magnets 50 were attached to return 42.

Figure 4:
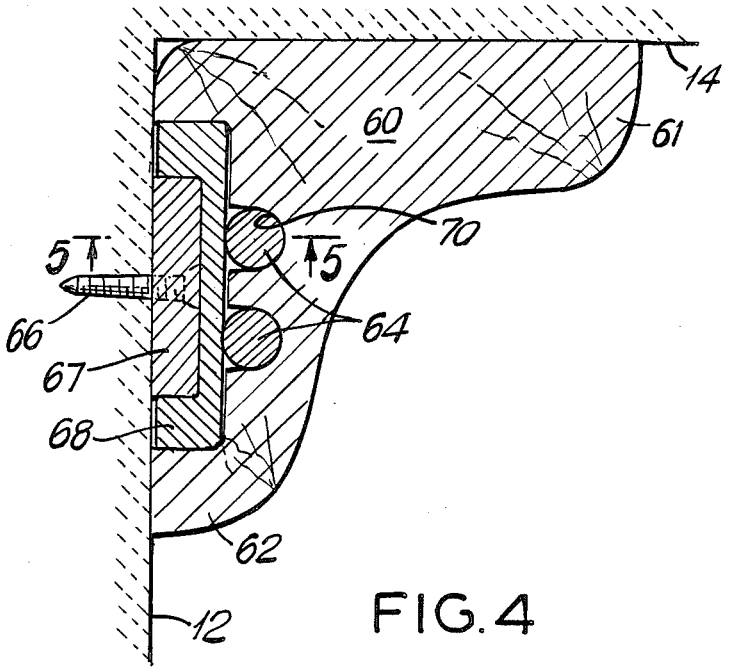
FIG. 4 is a cross section of an embodiment where metallic wires are embedded in a plastic molding's wall return.

Now referring to FIG. 4, a cross section of molding 60 is illustrated held to the intersection of wall 12 and ceiling 14. Magnet 68 is on backing 67 which is held to wall 12 by screw 66. Molding 60 is preferably plastic, although it may be wood. In this embodiment return 62 has been routed out to have grooves 70. Metallic wires 64 are pressed into grooves 70. As in FIGS. 1, 2, and 3, molding is held to a wall by the attraction of metallic wires 64 to a magnet on the wall. Thin wires 64 have been illustrated, but a metallic band, such as shown in FIGS. 1, 2 and 3 may be pressed into a widened groove 70 to achieve the same method as illustrated herein.

Figure 5:
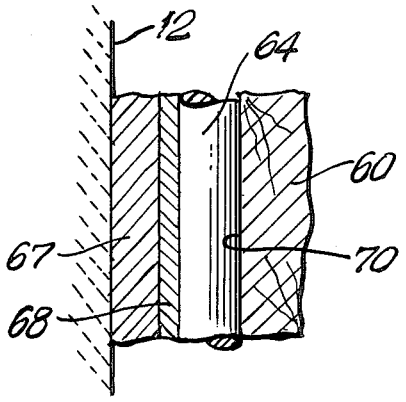
FIG. 5 is a cross section taken on lines 5—5 of FIG. 4 to show a wire embedded in a groove.

Now referring to FIG. 5, a cross section of molding 60 taken on lines 5—5 of FIG. 4 is seen. Wire 64 is pressed into groove 70 so that a length of wire 64 is exposed to magnet 68. It is evident that only a portion of wire 64 is exposed but that portion is enough to hold molding 60 to wall 12.

There are several variations possible within the scope of this invention. First is the variety of methods which may be used to fasten the magnetized metallic band or wires to either ceiling or wall return. Any method, clip, groove, or the like, which holds the metallic band or wire firmly in position is within the scope of this invention.

The molding may be metal, wood, or plastic, or any suitable material.

Although only one shape has been illustrated for the molding strip, any decorative or utilitarian design may be utilized as long as the returns abut the wall and ceiling and the magnetized metallic band is placed in contact with the magnetic mounting bars.

Additionally, the magnets may be attached to wall or ceiling or to either return or the molding. The metallic bands may be attached to the returns, or may form a continuous or noncontinuous strip along a wall or ceiling.

While magnets and metal strips have been illustrated, it should be understood that the remountable molding may use other means such as by using interlocking fabric fasteners of the VELCRO brand type in place of metallic strips and magnets.

There are a great number of advantages to the remountable molding of this inventor.

Chiefly, it is easily mounted, removed, and remounted to facilitate painting or redecorating a room.

Second, this remountable molding is versatile, adaptable to metal, wood, or plastic molding strips.

Having now illustrated and described my invention, it is not intended that such description limit this invention, but rather that this invention be limited only by reasonable interpretation of the appended claims.

What is claimed is:

1. A removable and remountable molding for a ceiling/wall or the like planar intersection, said molding comprising:

(a) a plurality of elongated magnetic mounting bars, said bars including attachment means for mounting said magnetic bars in spaced apart linear relationship outwardly from a flat surface proximate its intersection with another flat surface;

(b) at least one elongated molding member, said member being a single continuous strip including on its rear two flat-sided return spans, said returns being at generally right angles one to the other with one of said returns including an indented parallel area, said indented area being presized to match said mounting bars' outward projection when mounted; and, (c) at least one magnetized band attached to said molding strip at said indented return end, so that when said magnetic mounting bars are mounted proximate a planar surface intersection, said molding member may be removably mounted on said magnets by said magnetized band, said indented area on said return spacing the overfit of said molding member on said intersection to hide said mounting bars and to provide flush mounting of said molding to said intersection.

2. The removable and remountable molding according to claim 1 wherein said molding member is solid and said magnetized metal band is retained in a preformed longitudinal groove in said indented parallel area of said return.

3. The removable and remountable molding according to claim 1 wherein said molding member is metallic and hollow and wherein said magnetic bands extend from said indented parallel area end to form a planar parallel extension of said return.

4. A removable and remountable molding kit for ceiling/wall or the like planar intersection, said kit comprising:

(a) a plurality of elongated magnetic mounting bars, said bars including attachment means for mounting said magnetic bars in spaced apart linear relationship outwardly from a flat surface proximate its intersection with another flat surface;

(b) a plurality of elongated molding members, each said molding member being a single, continuous, hollow strip including on its rear two flat-sided return spans, said returns being at generally right angles one to the other with one of said returns including an indented parallel extension of said return, said indent being presized to match said mounting bars' outward projection when mounted; and, (c) at least one magnetized band attached to said extension, so that when said magnetic mounting bars are mounted proximate a planar surface intersection, said molding members may be removably mounted on said magnets by said magnetized band, said indentations on said returns spacing the overfit of said molded members on said intersection to hide said mounting bars and to provide flush mounting of said molding to said intersection.

5. The removable and remountable molding kit according to claim 4 wherein said molding member is metallic.

6. A removable and remountable molding for a ceiling/wall or the like planar intersection, said kit comprising:

(a) a plurality of elongated magnetic mounting bars, said bars including attachment means for mounting said magnetic bars in spaced apart linear relationship outwardly from a flat surface proximate its intersection with another flat surface;

(b) a plurality of elongated molding members, each said molding member being a single, continuous, generally solid strip including on its rear two flat-sided return spans, said returns being at generally right angles one to the other with one of said returns including an indentation sized to overfit said mounting bars' outward projection when mounted, said outer wall of said indentation including at least one longitudinal groove; and, (c) a magnetized wire band retained in said groove, so that when said magnetic mounting bars are mounted proximate a planar surface intersection, said molding member may be removably mounted on said magnets by said magnetized wire band, said indentation on said return spacing the overfit of said molding member on said intersection to hide said mounting bars and to provide flush mounting of said molding to said intersection.

* * * * *